US008840689B2

(12) United States Patent
Mathur et al.

(10) Patent No.: US 8,840,689 B2
(45) Date of Patent: Sep. 23, 2014

(54) AVIATION GASOLINE

(75) Inventors: Indresh Mathur, Sugar Land, TX (US); Jarvis J Brown, Houston, TX (US)

(73) Assignee: Johann Haltermann Limited, Houston, TX (US)

( * ) Notice: Subject to any disclaimer, the term of this patent is extended or adjusted under 35 U.S.C. 154(b) by 92 days.

(21) Appl. No.: 13/598,415

(22) Filed: Aug. 29, 2012

(65) Prior Publication Data

US 2013/0111805 A1 May 9, 2013

Related U.S. Application Data

(60) Provisional application No. 61/528,937, filed on Aug. 30, 2011.

(51) Int. Cl.

| | |
|---|---|
| ***C10L 1/12*** | (2006.01) |
| ***C10L 1/223*** | (2006.01) |
| ***C10L 1/06*** | (2006.01) |
| ***C10L 1/30*** | (2006.01) |
| ***C10L 1/224*** | (2006.01) |
| ***C10L 10/10*** | (2006.01) |

(52) U.S. Cl.

CPC . *C10L 1/224* (2013.01); *C10L 1/06* (2013.01); *C10L 1/223* (2013.01); *C10L 1/301* (2013.01); *C10L 1/306* (2013.01); *C10L 10/10* (2013.01); *C10L 2270/023* (2013.01)

USPC ..... 44/361; 44/426; 44/454

(58) Field of Classification Search

CPC ..... C10G 2300/305

USPC ..... 44/361, 426, 454

See application file for complete search history.

(56) References Cited

U.S. PATENT DOCUMENTS

| | | | | |
|---|---|---|---|---|
| 5,470,358 | A | 11/1995 | Gaughan | |
| 6,258,134 | B1 | 7/2001 | Studzinski et al. | |
| 6,451,075 | B1 * | 9/2002 | Schoppe et al. | 44/454 |
| 6,767,372 | B2 * | 7/2004 | Barnes et al. | 44/300 |
| 7,462,207 | B2 | 12/2008 | Clark | |
| 7,833,295 | B2 | 11/2010 | Clark | |
| 7,862,629 | B2 | 1/2011 | Gaughan et al. | |
| 7,897,034 | B2 | 3/2011 | DeOliveira et al. | |
| 8,049,048 | B2 | 11/2011 | Rusek et al. | |
| 2005/0229480 | A1 * | 10/2005 | Gaughan et al. | 44/412 |
| 2006/0086040 | A1 * | 4/2006 | De Oliveira et al. | 44/385 |
| 2008/0134571 | A1 | 6/2008 | Landschof et al. | |
| 2008/0289250 | A1 | 11/2008 | Bazzani et al. | |
| 2009/0013589 | A1 * | 1/2009 | Aradi et al. | 44/359 |
| 2010/0018112 | A1 | 1/2010 | Russo et al. | |
| 2010/0263262 | A1 * | 10/2010 | Gaughan | 44/347 |

* cited by examiner

*Primary Examiner* — Pamela H Weiss
(74) *Attorney, Agent, or Firm* — Butzel Long

(57) ABSTRACT

A high octane non-leaded gasoline meeting ASTM D910 LL standard is provided that includes a base gasoline fuel having a minimum MON of 96.5 and meeting the ASTM D910 standard. An octane-boosting component is mixed with the base gasoline fuel that raises the MON above 99.6 and the blended fuel complies with ASTM D910. The octane-boosting component is selected from a group including an additive, TEL only and a TEL containing gasoline.

7 Claims, 12 Drawing Sheets

The impact of m-Toluidine addition on MON of base fuel

| m-Toluidine Conc. (Volume %) | MON |
|---|---|
| 0 | 96.8 |
| 1.5 | 99.6 |
| 1.6 | 100 |
| 1.75 | 100 |

| Impact of Ferrocene Concentrations on Base Fuel MON | |
|---|---|
| Ferrocene Catalyst Conc (g/Gallon) | MON |
| 0 | 96.8 |
| 0.025 | 97.1 |
| 0.05 | 97.6 |
| 0.1 | 98 |
| 0.15 | 98.2 |
| 0.2 | 98.4 |

| Impact on Ferrocene Concentrations & 1.6% m-Toluidine on Base Fuel MON | |
|---|---|
| Ferrocene Catalyst Conc (g/Gallon) | MON |
| 0 | 100.0 |
| 0.025 | 100.1 |
| 0.05 | 100.3 |
| 0.1 | 100.4 |
| 0.15 | 100.5 |
| 0.2 | 100.6 |

| Impact of Various Additive's on Base Fuel MON | |
|---|---|
| | MON |
| Base Fuel | 96.8 |
| 0.025 g/gal Ferrocene | 97.1 |
| 0.05 g/gal Ferrocene | 97.6 |
| 0.1 g/gal Ferrocene | 98.0 |
| 0.15 g/gal Ferrocene | 98.2 |
| 0.2 g/gal Ferrocene | 98.4 |
| 1.4% Aniline | 99.4 |
| 1.75% Aniline | 100.1 |
| 1.5% m-Toluidine | 99.6 |
| 1.6% m-Toluidine | 100.0 |
| 1.75% m-Toluidine | 100.0 |
| 0.025 g/gal Ferrocene, 1.6% m-Toluidine | 100.1 |
| 0.05 g/gal Ferrocene, 1.6% m-Toluidine | 100.3 |
| 0.1 g/gal Ferrocene, 1.6% m-Toluidine | 100.4 |
| 0.15 g/gal Ferrocene, 1.6% m-Toluidine | 100.5 |
| 0.2 g/gal Ferrocene, 1.6% m-Toluidine | 100.6 |

FIG - 4A

100 MON Unleaded Aviation Gasoline with 1.6% m-Toluidine and 0.1g/gallon Ferrocene

| TEST | METHOD | UNITS | ASTM D910 SPECIFICATIONS | | | RESULTS |
|---|---|---|---|---|---|---|
| | | | MIN | TARGET | MAX | |
| Distillation - IBP | ASTM D86 | °C | | | | 36.5 |
| 5% | | °C | | | | 60.4 |
| 10% | | °C | | | 75 | 73.6 |
| 20% | | °C | | | | 89.8 |
| 30% | | °C | | | | 98.9 |
| 40% | | °C | 75 | | | 102.7 |
| 50% | | °C | | | 105 | 104.5 |
| 60% | | °C | | | | 106 |
| 70% | | °C | | | | 108.1 |
| 80% | | °C | | | | 112.7 |
| 90% | | °C | | | 135 | 126.2 |
| 95% | | °C | | | | 139 |
| Distillation - EP | | °C | | | 170 | 170 |
| Recovery | | vol % | 97.0 | | | 97.5 |
| Residue | | vol % | | | 1.5 | 1.0 |
| Loss | | vol % | | | 1.5 | 1.5 |
| T10 + T50 | | °C | 135.0 | | | 178.1 |

FIG - 5A

100 MON Unleaded Aviation Gasoline with 1.6% m-Toluidine and 0.1g/gallon Ferrocene

| TEST | METHOD | UNITS | ASTM D910 SPECIFICATIONS | | | RESULTS |
|---|---|---|---|---|---|---|
| | | | MIN | TARGET | MAX | |
| Gravity | | °API | | Report | | 62.0 |
| Density @15 °C | ASTM D4052 | kg/m³ | | Report | | 0.730 |
| Reid Vapor Pressure, 38 °C | ASTM D5191 | kPa | 38.0 | | 49.0 | 39.7 |
| Sulfur | ASTMD2622 | wt% | | | 0.05 | 0.0004 |
| Lead | ASTM D5059 | g/L | | | 0.56 | 0 |
| Freeze point | ASTM D2386 | °C | | | -58 | <-70 |
| Water reaction | ASTM D1094 | | | | | |
| Volume change | | vol % | | | 2 | -0.5 |
| Interface condition | | | | | | 1.0 |
| Degree of Separation | | | | | | 1.0 |
| Oxidation Stability, 5 hr | ASTM D873 | | | | | |
| Potential Gum, mg/100 mL | | mg/100mls | | | 6.0 | 6.0 |
| Lead Precipitate, mg/100 mL | | mg/100mls | | | 3.0 | 0.2 |
| Copper Corrosion, 2 hr @ 100° C | ASTM D130 | | | | 1 | 1a |
| Motor Octane Number | ASTM D2700 | | 99.6 | | | 100.4 |
| Net Heat of Combustion | ASTM D4529 | MJ/Kg | 43.5 | | | 43.5 |
| Electrical Conductivity | ASTM D2624 | pS/m | | | 450 | 13 |
| Performance Number | ASTM D909 | | 130.0 | | | >138.4 |

FIG - 5B

High MON Ultra low leaded Aviation Gasoline with 75% Base gasoline+25% 100LL and 0% m-Toluidine

| TEST | METHOD | UNITS | ASTM D910 SPECIFICATIONS | | | RESULTS |
|---|---|---|---|---|---|---|
| | | | MIN | TARGET | MAX | |
| Distillation - IBP | ASTM D86 | °C | | | | |
| 5% | | °C | | | | |
| 10% | | °C | | | 75 | **70.9** |
| 20% | | °C | | | | |
| 30% | | °C | | | | |
| 40% | | °C | 75 | | | **101.1** |
| 50% | | °C | | | 105 | **103.4** |
| 60% | | °C | | | | |
| 70% | | °C | | | | |
| 80% | | °C | | | | |
| 90% | | °C | | | 135 | **117.7** |
| 95% | | °C | | | | |
| Distillation - EP | | °C | | | 170 | **142.2** |
| Recovery | | vol % | 97.0 | | | **97.5** |
| Residue | | vol % | | | 1.5 | **1.0** |
| Loss | | vol % | | | 1.5 | **1.5** |
| T10 + T50 | | °C | 135.0 | | | **174.3** |

FIG - 6A

High MON Ultra low leaded Aviation Gasoline with 75% Base gasoline+25% 100LL and 0% m-Toluidine

| TEST | METHOD | UNITS | ASTM D910 SPECIFICATIONS | | | RESULTS |
|---|---|---|---|---|---|---|
| | | | MIN | TARGET | MAX | |
| Gravity | ASTM D4052 | °API | | Report | | **62.0** |
| Density @15 °C | ASTM D4052 | kg/m³ | | Report | | **0.730** |
| Reid Vapor Pressure, 38 °C | ASTM D5191 | kPa | 38.0 | | 49.0 | **41.2** |
| Sulfur | ASTMD2622 | wt% | | | 0.05 | **0.0004** |
| Lead | ASTM D5059 | TEL/G | | | 2.00 | **0.44** |
| Freeze point | ASTM D2386 | °C | | | -58 | **<-70** |
| Water reaction | ASTM D1094 | | | | | |
| Volume change | | vol % | | | 2 | **-0.5** |
| Interface condition | | | | | | **1.0** |
| Degree of Separation | | | | | | **1.0** |
| Oxidation Stability, 5 hr | ASTM D873 | | | | | |
| Potential Gum, mg/100 mL | | mg/100mls | | | 6.0 | **6.0** |
| Lead Precipitate, mg/100 mL | | mg/100mls | | | 3.0 | **0.2** |
| Copper Corrosion, 2 hr @ 100° C | ASTM D130 | | | | 1 | **1a** |
| Motor Octane Number | ASTM D2700 | | 99.6 | | | **101.1** |
| Net Heat of Combustion | ASTM D4529 | MJ/Kg | 43.5 | | | **>43.502** |
| Electrical Conductivity | ASTM D2624 | pS/m | | | 450 | **13** |
| Performance Number | ASTM D909 | | 130.0 | | | **131** |

*FIG - 6B*

High MON Ultra low leaded Aviation Gasoline with 75% Base gasoline+25% 100LL and 1.6% m-Toluidine

| TEST | METHOD | UNITS | ASTM D910 SPECICIATIONS | | | RESULTS |
|---|---|---|---|---|---|---|
| | | | MIN | TARGET | MAX | |
| Distillation - IBP | ASTM D86 | °C | | | | 33.4 |
| 5% | **70.9** | °C | | | | |
| 10% | | °C | | | 75 | 70.6 |
| 20% | | °C | | | | |
| 30% | **101.1** | °C | | | | |
| 40% | | °C | 75 | | | 101.3 |
| 50% | | °C | | | 105 | 103.8 |
| 60% | | °C | | | | |
| 70% | | °C | | | | |
| 80% | | °C | | | 135 | 121.5 |
| 90% | | °C | | | | |
| 95% | | °C | | | | |
| Distillation - EP | | °C | | | 170 | 164.1 |
| Recovery | | vol % | 97.0 | | | 97.5 |
| Residue | | vol % | | | 1.5 | 1.0 |
| Loss | | vol % | | | 1.5 | 1.5 |
| T10 + T50 | | °C | 135.0 | | | 174.4 |

FIG - 7A

High MON Ultra low leaded Aviation Gasoline with 75% Base gasoline+25% 100LL and 1.6% m-Toluidine

| TEST | METHOD | UNITS | ASTM D910 SPECICIATIONS | | | RESULTS |
|---|---|---|---|---|---|---|
| | | | MIN | TARGET | MAX | |
| Gravity | ASTM D4052 | °API | | Report | | 62.0 |
| Density @15 °C | ASTM D4052 | kg/m³ | | Report | | 0.730 |
| Reid Vapor Pressure, 38 °C | ASTM D5191 | kPa | 38.0 | | 49 | 40.8 |
| Sulfur | ASTMD2622 | wt% | | | 0.05 | 0.0004 |
| Lead | ASTM D5059 | TEL/G | | | 2.00 | 0.44 |
| Freeze point | ASTM D2386 | °C | | | -58 | <-70 |
| Water reaction | ASTM D1094 | | | | | |
| Volume change | | vol % | | | 2 | -0.5 |
| Interface condition | | | | | | 1.0 |
| Degree of Separation | | | | | | 1.0 |
| Oxidation Stability, 5 hr | ASTM D873 | | | | | |
| Potential Gum, mg/100 mL | | mg/100mls | | | 6.0 | 6.0 |
| Lead Precipitate, mg/100 mL | | mg/100mls | | | 3.0 | 0.2 |
| Copper Corrosion, 2 hr @ 100° C | ASTM D130 | | | | 1 | 1a |
| Motor Octane Number | ASTM D2700 | | 99.6 | | | 101.6 |
| Net Heat of Combustion | ASTM D4529 | MJ/Kg | 43.5 | | | >43.502 |
| Electrical Conductivity | ASTM D2624 | pS/m | | | 450 | 13 |
| Performance Number | ASTM D909 | | 130.0 | | | 143 |

FIG - 7B

AVIATION GASOLINE

RELATED APPLICATION

The present application claims priority to U.S. Patent Application Ser. No. 61/528,937 filed Aug. 30, 2011, the entire contents of which is incorporated herein by reference.

FIELD OF THE INVENTION

The present disclosure relates generally to aviation gasoline, and more particularly to an improved high octane non-leaded or ultra-low leaded aviation gasoline fuel that meets the ASTM D910 100LL standard.

BACKGROUND

Vehicles having a spark ignited piston engine as a power source use gasoline as a fuel source. Previously, leaded gasoline included Tetra-ethyl lead (TEL) as an additive to improve the octane of the fuel. However, lead was identified as a neurotoxin and its phase out began in the 1970s. TEL was completely banned by the Environmental Protection Agency (EPA) for use in gasoline targeted for automotive vehicles in 1995. Presently, General Aviation (GA) aircrafts having a spark-ignited piston engine utilize leaded gasoline as a fuel source. To date, aviation gasoline (av-gas) has been exempt from the mandatory lead phase out because of the aviation industry's inability to come up with an unleaded gasoline that could satisfy the octane needs of all current engines used for aviation purposes.

While the grade 94 unleaded (94UL) av-gas governed by ASTM D7592 standard is currently approved for commercial sale, its use is limited to low compression engines due to the lower octane rating of the fuel. The performance needs of a higher horsepower normally aspirated engine, such as a 300 hp engine with 8.5:1 compression ratio, are not satisfied by the 94UL fuel because of the lower Motor Octane (MON) rating of 94UL fuel.

Every fuel, including those designated as leaded aviation gasoline i.e. grade 80, grade 91, grade 100, grade 100LL or grade 100VLL, must satisfy a predetermined ASTM standard, which in the case of av-gas is D910. ASTM standard D910 establishes limits on predetermined parameters and performance specifications that the fuel must meet. For example, ASTM standard D910 sets the maximum level of lead allowable in a particular grade of av-gas, but does not set the limits on the minimum lead content. The maximum TEL allowed has been lowered from 4.0 mL TEL/gal (grade 100) to 2.0 mL/gal (grade 100LL) to 1.63 mL/gal (grade 100VLL). Grade 100VLL is identical to grade 100LL in all aspects, except maximum lead content is reduced by only 19%.

Any new fuel must undergo rigorous testing to insure compliance with the D910 standard. If a new fuel deviates from this standard, then there may be additional fuel certification costs, as measured in time and money. There could also be consumer costs due to possible modifications required by engines already in use.

Thus, there is a need in the art for a high octane non-leaded or ultra low leaded (i.e. 0-1.6 TEL/gal) replacement gasoline that is formulated to already be in compliance with the ASTM 910 standard for aviation fuel and is available for aviation purposes.

SUMMARY OF THE DISCLOSURE

Accordingly, an improved aviation fuel that is a high octane non-leaded or ultra low leaded gasoline, and capable of meeting ASTM D910 standard is provided. The improved aviation fuel includes a base gasoline fuel having a minimum MON of 96.5 and meeting the ASTM D910 standard. An octane-boosting component is mixed with the base gasoline fuel that raises the MON above 99.6 and the blended fuel complies with ASTM D910. The octane-boosting component is selected from a group including an additive, TEL by itself or a TEL containing gasoline. The goal of this invention was to provide an av-gas with the best anti-knock performance (i.e. high MON) with little or no TEL when compared to commercially available av-gas available today.

An advantage of the present disclosure is that an improved aviation fuel is provided that still meets the ASTM D910 standard. Another advantage of the improved aviation fuel is that it can be a non-leaded aviation fuel, or a blend containing unleaded and an ultra low leaded equivalent of 100LL and 100VLL. Another advantage of the present disclosure is that the av-gas meets the ASTM D910 standard without requiring changes to the engine. Still another advantage is that the lead-free or ultra low leaded av-gas does not affect engine operation or aircraft safety. A further advantage of the present disclosure is that the improved non-leaded or ultra low leaded av-gas of this invention is less expensive to seek regulatory or manufacturer approval since the improved fuel already meets all the requirements of the ASTM standard D910 for av-gas. Still a further advantage of the present disclosure is that alignment of the unleaded or ultra low leaded av-gas with the ASTM D910 standard makes it easier for the FAA and the engine/airframe manufactures to approve the new fuel for commercial use in all compatible airplanes. Yet a further advantage of the present disclosure is that the improved aviation fuels are similar to presently available leaded fuels (100LL and 100VLL), and since they contain little or no TEL, are able to meet MON demand and other parameters that are specified in ASTM D910. Yet still a further advantage of the present disclosure is that the fuels of this invention are optimized for octane by the addition of components that boost octane number and these fuels can be blended with TEL additive or 100LL or 100VLL to further increase the MON without being out of compliance with the ASTM D910 standard. Still yet a further advantage of the present disclosure is that that an unleaded or ultra low leaded equivalent of 100LL and 100VLL (that meets all the ASTM D910 requirements) can be formulated utilizing common components that can be easily manufactured at a refinery or chemicals that are commercially available. Still yet a further advantage of the present disclosure is that the improved fuel meets the requirements for use as a "drop in fuel" since it is mixable with other commercially approved fuels and does not impact performance of the engine.

Other features and advantages of the present disclosure will become readily appreciated, as the same becomes better understood after reading the following description when considered in conjunction with the accompanying drawings.

DESCRIPTION OF THE DRAWINGS

FIG. 4*a* is a table summarizing the MON for various octane data combinations.

FIG. 5*a* is a table summarizing a distillation profile demonstrating compliance of a 100 MON Unleaded Aviation Gasoline with the ASTM D910 Specification.

FIG. 5*b* is a table summarizing other properties demonstrating compliance of a 100 MON Unleaded Aviation Gasoline with the ASTM D910 Specification.

FIG. 6*a* is a chart summarizing a distillation profile from test results demonstrating compliance of an Unleaded Aviation Gasoline (without m-Toluidine) when blended with 25% 100LL to produce an ultra low lead av-gas meeting the ASTM D910 Specification.

FIG. 6*b* is a chart summarizing other properties from test results demonstrating compliance of an Unleaded Aviation Gasoline (without m-Toluidine) when blended with 25% 100LL to produce an ultra low lead av-gas meeting the ASTM D910 Specification.

FIG. 7*a* is a chart summarizing a distillation profile from test results demonstrating compliance of an Unleaded Aviation Gasoline (with 1.6% m-Toluidine) when blended with 25% 100LL to produce an ultra low lead av-gas meeting the ASTM D910 Specification.

FIG. 7*b* is a chart summarizing other properties from test results demonstrating compliance of an Unleaded Aviation Gasoline (with 1.6% m-Toluidine) when blended with 25% 100LL to produce an ultra low lead av-gas meeting the ASTM D910 Specification.

DESCRIPTION

Figures 1A, 8:
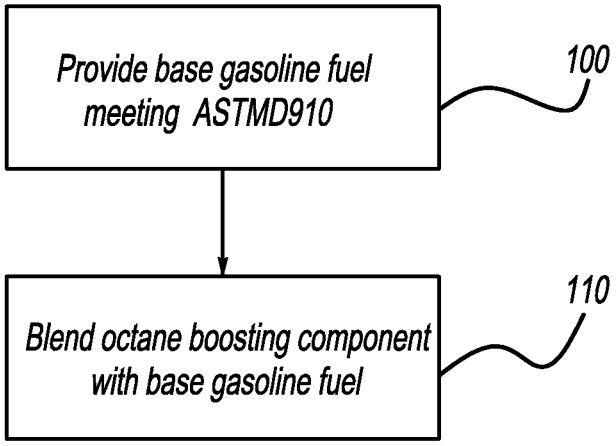
FIG. 1*a* is a table illustrating the impact of m-Toluidine on the MON of the base gasoline fuel.
FIG. 8 is a flowchart illustrating a method of making an improved aviation fuel.

Referring to the FIGS. 1-7, an improved aviation gasoline fuel that meets the ASTM D910 standard for 100LL and 100VLL is provided. The improved aviation fuel contains a base gasoline fuel that is already in compliance with ASTM D910 and an octane-boosting component that improves the motor octane (MON) rating of the fuel. The base gasoline fuel used in the formulation of the improved aviation fuel may be an unleaded av-gas or an ultra low leaded av-gas, although the selection is non-limiting and other types of base gasoline fuels are contemplated. For example, the unleaded av-gas includes a base gasoline fuel having a minimum MON of 96.5. To achieve the minimum MON of 96.5, the base gasoline fuel may be formulated by blending in the optimized amount of base gasoline fuel components such as iso-octane, alkylate, toluene, m-xylene, isopentane and butane. The ratio of the blended base gasoline fuel components is selectively determined so that the base gasoline fuel still meets the D-86 distillation profile, vapor pressure, heat of combustion, and freeze point requirements stipulated in ASTM D910. The ratio of blended components is generally determinable by volume.

Once established that the base gasoline fuel is in compliance with ASTM D910, the base gasoline fuel can be further optimized in order to meet the minimum 99.6 MON requirements of ASTM D910 standard by the addition of an additive package selected to boost the octane rating of the base gasoline fuel to greater than 100 MON, while retaining compliance with ASTM D910. The base gasoline fuel is enhanced by mixing an octane-boosting component with the base gasoline fuel that raises the MON above 99.6, while still complying with ASTM D910. The av-gas of this example utilizes octane-boosting components that are readily available in a refinery environment and economically feasible in the market. The improved av-gas of the present disclosure can comply with a "fit for purpose" standard associated with aviation fuel. Thus the improved fuel achieves a MON high enough to avoid engine performance concerns such as engine knock, while at the same time meeting the distillation profile, vapor pressure, heat of combustion and other parameters that must be complied with as set forth in ASTM D910. The presently described fuel does not include any oxygenates.

In an example, the base gasoline fuel can be formulated by blending together (by volume) 50-70% iso-octane, 8-14% isopentane, 0-26%, toluene 0-26% m-xylene (or mixed xylene), 2% isobutane. The resulting formulation of a base gasoline fuel and selected octane-boosting component behaves like 100LL and 100VLL and still meets the ASTM D910 specifications with little or no lead in the final fuel.

In another example, the base gasoline fuel may be formulated using 66% iso-octane, 13% isopentane, 2% isobutane and 19% m-xylene, (by volume) blended to produce a base gasoline fuel having a 96.8 MON. The selected octane-boosting component is then blended with the base gasoline fuel to achieve an improved av-gas that complies with all the requirements of ASTM D910 with little or no lead in the final fuel.

In still another example, a base gasoline fuel meeting ASTM D910 is initially formulated to have a MON of 96.8 by mixing (by volume) 60% iso-octane, 12.5% isopentane, 2% isobutane, 9.5% toluene and 16% m-xylene. Again, the addition of the selected octane boosting component to the base gasoline fuel results in an av-gas that complies with ASTM D910 specifications with little or no lead in the final fuel.

In yet another example, a base gasoline fuel with a MON of 96.7 and meeting ASTM D910 can be formulated by mixing (by volume) 56% iso-octane, 9% isopentane, 7% light alkylate, 2.5% isobutane, 9.5% toluene and 16% m-xylene. The addition of the selected octane-boosting component to the base gasoline fuel similarly results in an av-gas that complies with ASTM D910 specifications with little or no lead in the final fuel.

In a further example, a high octane base gasoline fuel (MON 97.3) may be produced by mixing (by volume) 64% iso-octane, 11% isopentane, 2.5% isobutane, 6.5% mixed xylene and 8% mesitylene (1,3,5 trimethylbenzene). Though the MON of this formulation is high, the fuel's distillation end point slightly exceeds the ASTM specification of 170 deg. C. While this formulation worked, mesitylene may not currently be commercially available for other reasons.

The octane-boosting component may be selectively formulated to further boost the MON of the base gasoline fuel and various types of octane boosting components may be Utilized. It should be appreciated that the concentration of the octane-boosting component in the fuel, either by weight or volume, may be controlled to insure compliance with the various specifications of the ASTM 910 standard, such as the D86 boiling point endpoint, the freezing point of the av-gas, or the like. For example, the standard requires that the freezing point of the av-gas be less than −58 deg. C. However, certain components may have a freezing point that is above this level, so a predetermined amount of toluene may also be blended with the base gasoline fuel to maintain the freezing point within the specified range.

An example of an octane boosting component is the addition of a small amount of lead (TEL), such as up to 0.44 ml TEL/gal that is directly added to the base gasoline fuel. Referring to FIGS. 6*a* and 6*b*, the impact of the direct addition of TEL to unleaded av-gas is illustrated. Another example of an octane-boosting component is the addition of a predetermined amount of presently approved av-gas to the base gasoline fuel, such as 100LL or 100VLL. The MON of the fuel may be further increased, such as to 101, to provide an improved aviation fuel that may be considered an ultra low leaded av-gas. ASTM D910 compliance is therefore maintained by blending in 0.44 mL TEL/gal lead or by blending in unleaded av-gas containing 25% by volume of 100LL to the base gasoline fuel.

Still another example of an octane-boosting component is additive that raises the MON. In this context, an additive (as defined by the ASTM committee for aviation fuels) is considered to be a substance that is added to a base aviation gasoline in relatively small amounts that either enables that base aviation gasoline to meet the applicable specification properties, or does not alter the applicable specification properties of that base aviation gasoline beyond allowable limits.

An example of an additive is an aromatic amine, or a mixture of TEL and an aromatic amine. The judicious addition of an aromatic amine to the base gasoline fuel further improves the resultant MON of the blended fuel to 100 MON.

An example of an aromatic amine is meta-toluidine or the like. The amount of m-Toluidine added to the base gasoline fuel may be minimized while achieving a MON of 100, since the initial MON of the base gasoline fuel is maximized. This strategy is advantageous due to the inherent toxicity of m-Toluidine and other properties such as its propensity to form gums, higher freezing and boiling point. For example, the 1.6% vol. addition of m-Toluidine optimally results in parameters, such as an end point (170 deg. C) of the D-86 distillation curve for the ASTM D910 that is not exceeded and the freezing point of less than −58 deg. C for the final fuel is met, as shown in FIG. 1.

The octane-boosting component may be a blend of octane-boosting components. Examples of octane boosting component blends includes lead and an additive, such as m-Toluidine, and/or TEL, and/or ferrocene, and/or phenolic amines dissolved in a solvent, which could be toluene, m-xylene or the base gasoline fuel itself.

Ultra low lead av-gas meeting ASTM D910 specifications can also be made by adding TEL directly to the base gasoline fuel or the base gasoline fuel with m-Toluidine. As shown in FIGS. 7*a* and 7*b*, 25% of commercially available 100LL can be mixed with up to 1.6% vol, m-Toluidine to achieve an ultra low leaded av-gas. Ultra low leaded av-gas, meeting the ASTM D910, can also be made by blending the base gasoline fuel, with or without m-Toluidine, and commercially available 100LL or 100VLL av-gas in proportions that result in 0-1.6 mL TEL in the resultant av-gas.

Figures 3A, 3B:
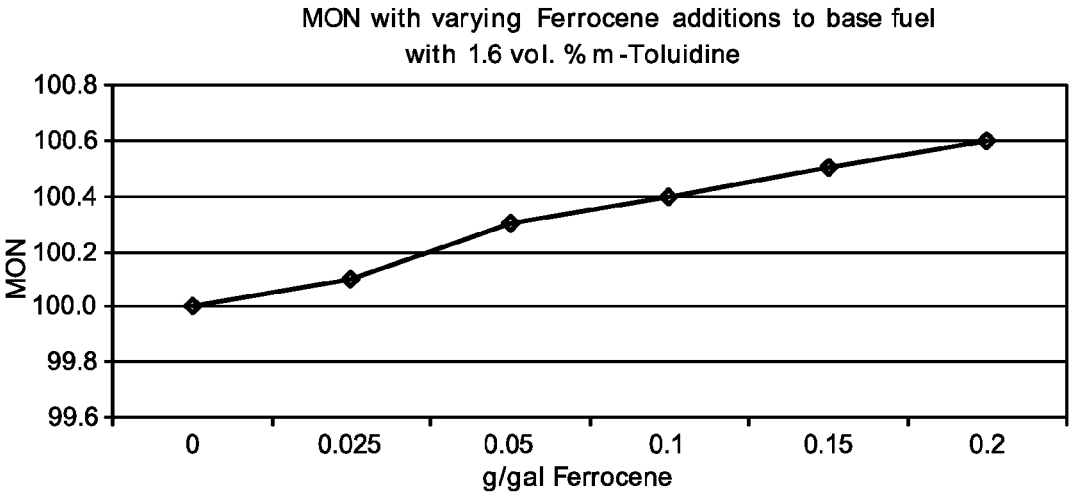
FIG. 3*a* is a table illustrating the impact of the combined addition of m-Toluidine and ferrocene catalyst on the MON of the base gasoline fuel.
FIG. 3*b* is a graph illustrating the impact of the combined addition of m-Toluidine and ferrocene catalyst on the MON of the base gasoline fuel.
Figure 3C:
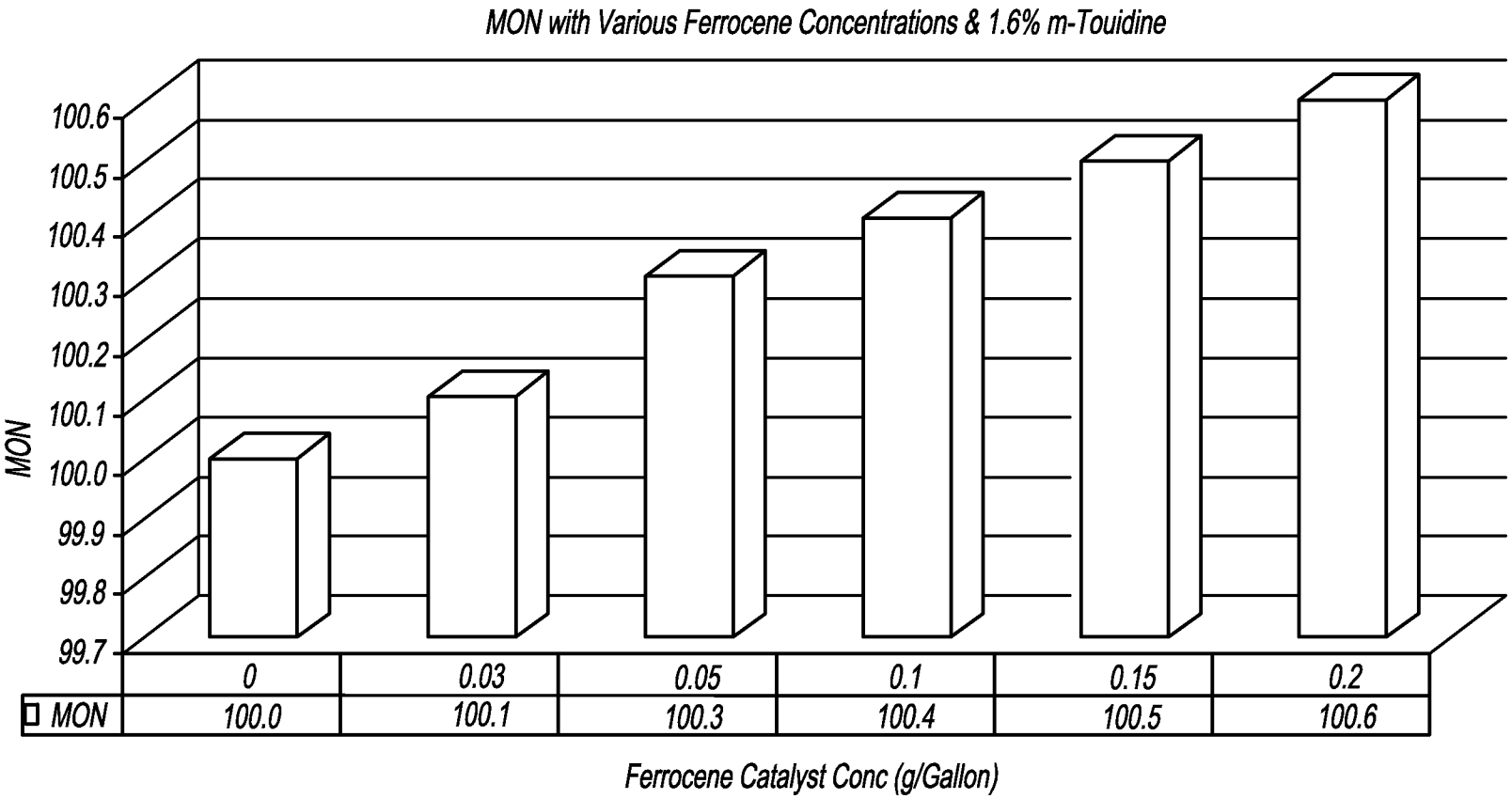
FIG. 3*c* is a chart illustrating the impact of the combined addition of m-Toluidine and ferrocene catalyst on the MON of the base gasoline fuel.

Referring back to FIGS. 2*a* and 2*b*, a further example of the use of a ferrocene catalyst as an additive to raise the resultant MON of the base gasoline fuel is illustrated. Referring to FIGS. 3*a*, 3*b* and 3*c*, still a further example of the use of m-Toluidine and a ferrocene catalyst as an additive to raise the resultant MON is illustrated. The supercharge octane performance number of the av-gas can approach >130 and a, MON>100 may be possible through the addition of 0.1 g ferrocene/gallon to the m-Toluidine additized base gasoline fuel. The net result of such an additive is an av-gas having a MON approaching 102 by increasing the amount of additives. While the higher MON results in improved engine performance, such as better knock characteristics, there is the potential that such an av-gas may not meet all of the required ASTM D910 specifications.

The octane-boosting component may include the use of an additional additive for a particular purpose, such as to mitigate gum formation resulting from the addition of aromatic amines. The deposit of toluene insoluble deposits resulting from the use of m-Toluidine may also be minimized as a result of the addition of small amounts of m-Toluidine to the base gasoline fuel. It should be appreciated that detergents may be added to prevent the deposit of toluene insoluble in av-gas containing 1-20% amines.

A fuel having a MON higher than 100 may be desirable for use in a high-performance engine to further enhance combustion characteristics of the engine. This can be achieved by the addition of m-Toluidine alone or in combination of m-Toluidine and a catalyst, such as ferrocene or the addition of small quantities of TEL by direct addition of TEL or blending commercial leaded gasoline like 100LL or 100VLL in proportions appropriate to impart the required boost in octane performance.

Referring to FIGS. 4*a* and 4*b*, a summary of the MON for various blends of av-gas is depicted. In FIG. 5, the test results for an av-gas having a MON of 100 are presented. As described, FIGS. 6*a* through 7*b* illustrate how a MON greater than 101 can be achieved while still meeting ASTM D910 compliance. This can be achieved through the addition of small quantities of TEL as is or by blending 25% 100LL into the unleaded gasoline of this innovation. The data provided illustrates compliance of the av-gas with the ASTM D910 requirements at TEL content well below the industry average for 100VLL.

Figure 1B:
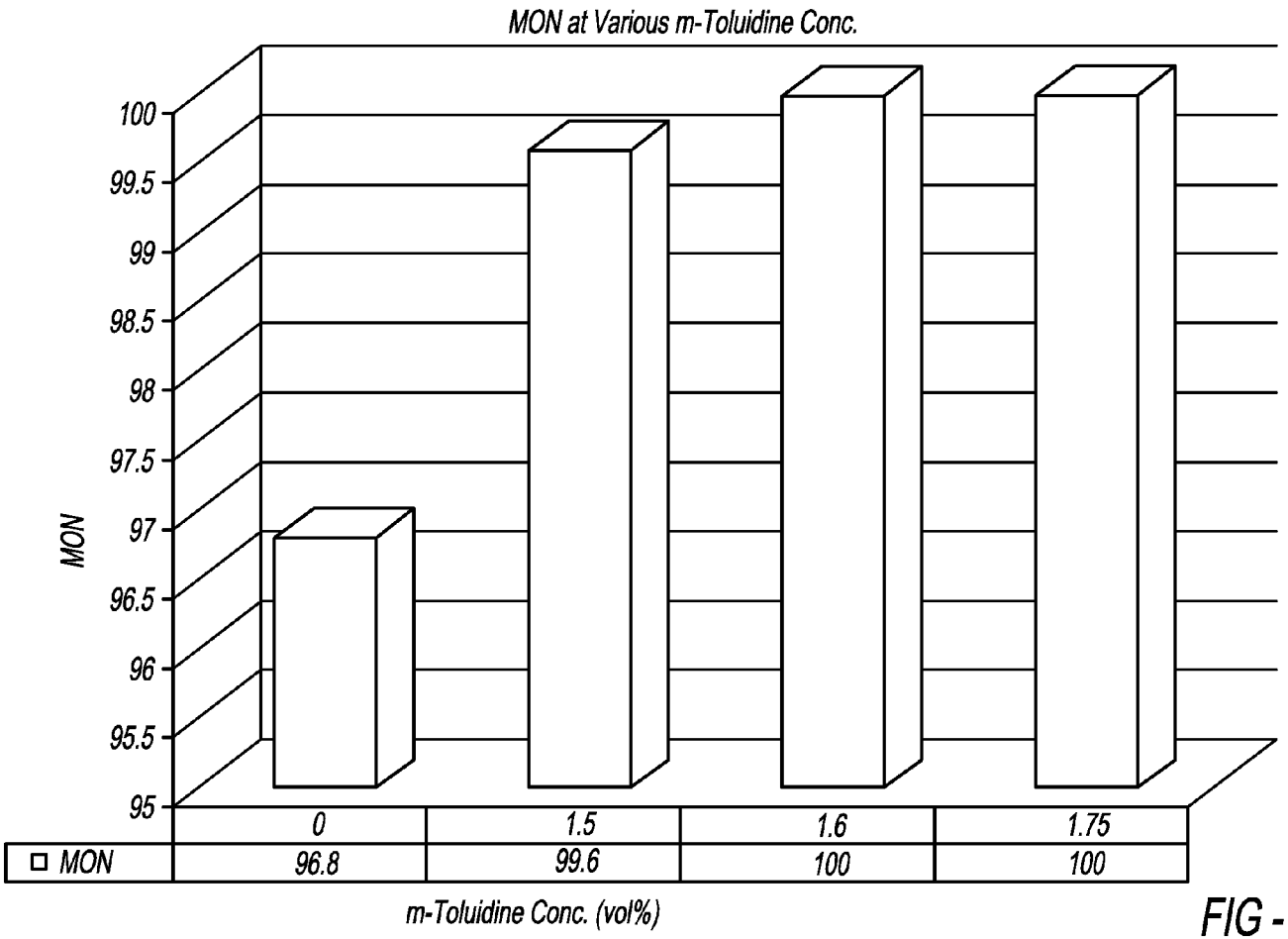
FIG. 1*b* is another graph illustrating the impact of m-Toluidine on the MON of the base gasoline fuel.
Figures 2A, 2B:
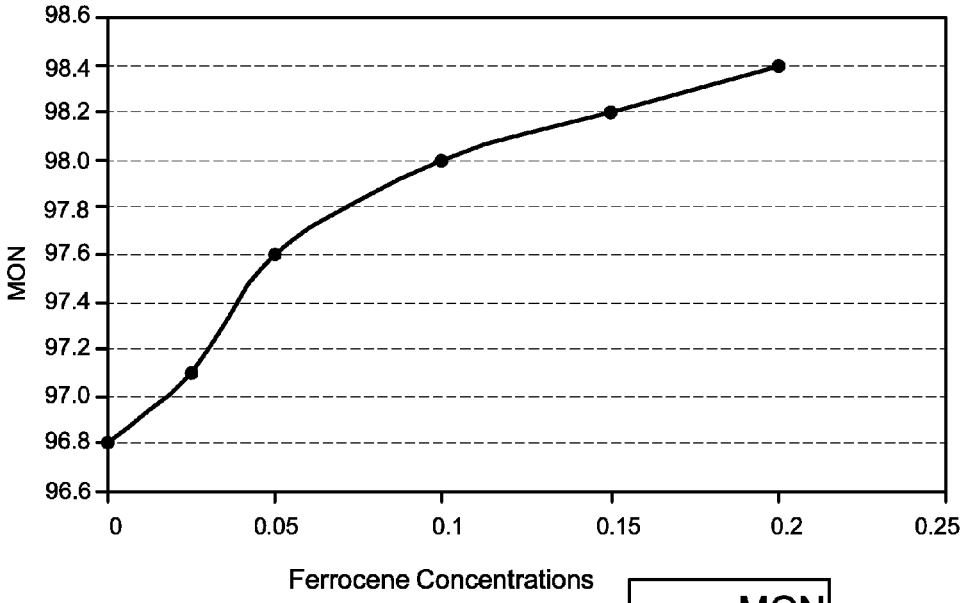
FIG. 2*a* is a table illustrating the impact of a ferrocene catalyst on the base gasoline fuel MON.
FIG. 2*b* is a graph illustrating the influence of a ferrocene catalyst on the base gasoline fuel MON.

Referring to FIG. 8, a method of making an improved aviation fuel that meets the ASTM D910 standard is provided. The method begins in block 100 with the step of providing a base gasoline fuel having an initial minimum MON of 96.5. Various types of base gasoline fuels are contemplated, as previously described, such as an unleaded av-gas or low leaded av-gas. The base gasoline fuel is in compliance with ASTM D910.

The methodology advances to block 110 and an octane-boosting component is blended with the base gasoline fuel. As previously described, the octane-boosting component may be a predetermined amount of lead (TEL) or a leaded fuel, an additive, or a combination of lead and an additive, as previously described. The octane-boosting component is selectively determined so that the MON of the end or blended fuel is greater than 99.6. Since the base gasoline fuel and octane-boosting component each comply with ASTM D910, the end fuel also is in compliance with ASTM D910.

The present disclosure has been described in an illustrative manner. It is to be understood that the terminology which has been used is intended to be in the nature of words of description rather than of limitation. Many modifications and variations of the present example are possible in light of the above teachings. Therefore, within the scope of the appended claims, the present disclosure may be practices other than as specifically described.

What is claimed is:

1. An aviation gasoline fuel comprising:

a base gasoline fuel having a minimum MON of 96.5 and complying with all requirements of ASTM D910 standard;

a first octane-boosting component mixed with the base gasoline fuel, wherein the first octane-boosting component is meta-toluidine in an amount of from about 1.5 volume percent to about 1.75 volume percent; and a second octane-boosting component mixed with the base gasoline fuel, wherein the second octane-boosting component is ferrocene in an amount of from about 0.025 to about 0.2 grams per gallon of the aviation gasoline fuels wherein the resulting aviation gasoline fuel has a MON greater than 100.

2. The aviation fuel of claim 1 further comprising octane-boosting TEL.

3. The aviation fuel of claim 1 wherein the resulting aviation gasoline fuel is an ultra-low leaded gasoline aviation fuel.

4. The aviation fuel of claim 1 further comprising a leaded aviation fuel.

5. The aviation fuel of claim 4 wherein the leaded aviation fuel is Grade 100LL or Grade 100VLL leaded gasoline fuel.

6. The aviation fuel of claim 1 further comprising an octane-boosting 100LL aviation fuel.

7. The aviation fuel of claim 1 wherein the base gasoline fuel comprises, by volume, 50-70% iso-octane, 8-14% iso-pentane, 0-26% toluene, 0-26% m-xylene, and iso-butane.

* * * * *